US007405697B2

(12) United States Patent
Ying

(10) Patent No.: US 7,405,697 B2
(45) Date of Patent: Jul. 29, 2008

(54) COMPACT DIVERSITY ANTENNA

(76) Inventor: Zhinong Ying, Skyttejinjen 50, SE-226 49 Lund (SE)

( * ) Notice: Subject to any disclaimer, the term of this patent is extended or adjusted under 35 U.S.C. 154(b) by 15 days.

(21) Appl. No.: 10/549,717

(22) PCT Filed: Feb. 18, 2004

(86) PCT No.: PCT/EP2004/001503

§ 371 (c)(1),
(2), (4) Date: Sep. 16, 2005

(87) PCT Pub. No.: WO2004/084344

PCT Pub. Date: Sep. 30, 2004

(65) Prior Publication Data

US 2006/0220959 A1 Oct. 5, 2006

Related U.S. Application Data

(60) Provisional application No. 60/458,170, filed on Mar. 27, 2003.

(30) Foreign Application Priority Data

Mar. 18, 2003 (EP) ..... 03075785

(51) Int. Cl.
*H01Q 1/38* (2006.01)
*H01Q 1/24* (2006.01)
*H01Q 3/24* (2006.01)

(52) U.S. Cl. ..... 343/700 MS; 343/702; 343/876

(58) Field of Classification Search ..... 343/700 MS, 343/846, 876, 702
See application file for complete search history.

(56) References Cited

U.S. PATENT DOCUMENTS

| | | | | |
|---|---|---|---|---|
| 4,367,474 | A | 1/1983 | Schaubert et al. | 343/700 |
| 6,104,356 | A * | 8/2000 | Hikuma et al. | 343/853 |
| 6,211,830 | B1 * | 4/2001 | Monma et al. | 343/702 |
| 6,369,762 | B1 * | 4/2002 | Yanagisawa et al. | 343/700 MS |

(Continued)

FOREIGN PATENT DOCUMENTS

| | | |
|---|---|---|
| EP | 0 872 912 | 3/2005 |

(Continued)

OTHER PUBLICATIONS

International Preliminary Examination Report for PCT/EP2004/001503.

*Primary Examiner*—Hoang V Nguyen
*Assistant Examiner*—Robert Karacsony
(74) *Attorney, Agent, or Firm*—Myers Bigel Sibley & Sajovec

(57) ABSTRACT

A diversity radio antenna includes a ground substrate and two elongated antenna elements. The antenna elements each extend between respective opposing ends thereof in a plane parallel to and spaced from the ground substrate. An excitation electrode is interposed between the respective ends. A ground connector switch is configured to selectively connect and disconnect the ground substrate to the antenna elements for controlling radiation beam pattern and polarisation diversity of the antenna. The ground connector switch is configured to selectively connect the antenna elements to the ground substrate for adapting the antenna to a circularly-polarised radio wave, or to disconnect one of the antenna elements from the ground substrate for adapting the antenna to a linearly-polarised radio wave.

19 Claims, 4 Drawing Sheets

U.S. PATENT DOCUMENTS

| | | | | |
|---|---|---|---|---|
| 6,600,456 | B2 * | 7/2003 | Gothard et al. | 343/834 |
| 6,771,223 | B1 * | 8/2004 | Shoji et al. | 343/702 |
| 7,212,164 | B2 * | 5/2007 | Miyano et al. | 343/702 |
| 2003/0076272 | A1 * | 4/2003 | Kurjenheimo et al. | 343/829 |
| 2004/0056804 | A1 * | 3/2004 | Kadambi et al. | 343/700 MS |
| 2004/0174302 | A1 * | 9/2004 | Robin | 343/700 MS |

FOREIGN PATENT DOCUMENTS

| | | |
|---|---|---|
| WO | 02/071535 | 9/2002 |

* cited by examiner

COMPACT DIVERSITY ANTENNA

RELATED APPLICATIONS

The present application is a 35 U.S.C. §371 national phase application of PCT International Application No. PCT/EP2004/001503, having an international filing date of Feb. 18, 2004 and claiming priority to European Patent Application No. 03075785.0, filed Mar. 18, 2003 and U.S. Provisional Application No. 60/458,170 filed Mar. 27, 2003, the disclosures of which are incorporated herein by reference in their entireties. The above PCT International Application was published in the English language and has International Publication No. WO 2004/084344.

FIELD OF THE INVENTION

The present invention relates generally to antennas for radio communication terminals and, in particular, to compact antennas devised to be incorporated into portable terminals, and which are capable of transmission and reception diversity.

BACKGROUND

Since the end of the 20$^{th}$ century the cellular telephone industry has had enormous development in the world. From the initial analog systems, such as those defined by the standards AMPS (Advanced Mobile Phone System) and NMT (Nordic Mobile Telephone), the development has during recent years been almost exclusively focused on standards for digital solutions for cellular radio network systems, such as D-AMPS (e.g:, as specified in EIA/TIA-IS-54-B and IS-136) and GSM (Global System for Mobile Communications). Different digital transmission schemes are used in different systems, e.g. time division multiple access (TDMA) or code division multiple access (CDMA). Currently, the cellular technology is entering the so called 3$^{rd}$ generation, providing several advantages over the former, 2$^{nd}$ generation, digital systems referred to above. Among those advantages an increased bandwidth will be provided, allowing effective communication of more complex data. The 3$^{rd}$ generation of mobile systems have been referred to as the UMTS (Universal Mobile Telephony System) in Europe and CDMA2000 in the USA, and is already implemented in Japan to some extent. Furthermore, it is widely believed that the first generation of Personal Communication Networks (PCNs), employing low cost, pocket-sized, cordless telephones that can be carried comfortably and used to make or receive calls in the home, office, street, car, etc., will be provided by, for example, cellular carriers using the next generation digital cellular system infrastructure.

A lot of effort has been made in making smaller terminals, with much help from the miniaturisation of electronic components and the development of more efficient batteries. In only a couple of decades the communication systems have gone from analogue to digital, and at the same time the dimensions of the communication terminals have gone from briefcase size to the pocket size phones of today. Today, numerous manufacturers offer pocket-sized terminals with a wide variety of capabilities and services, such as packet-oriented transmission and multiple radio band coverage. In order to reduce the size of the portable radio terminals, built-in antennas have been implemented over the last couple of years. The general desire today is to have an antenna, which is not visible to the customer. Today different kinds of patches are used, with or without parasitic elements. The most common built-in antennas currently in use in mobile phones include are the so called planar inverted-F antennas (PIFA). This name has been adopted du to the fact that the antenna looks like the letter F tilted 90 degrees in profile. Such an antenna needs a feeding point as well as a ground connection. If one or several parasitic elements are included nearby, they can be either grounded or dielectrically separated from ground.

The development in electronics has not only made it possible to miniaturise the components of the terminals, the complexity and variety of advanced functions and services which the terminals are capable of performing is also ever increasing. The development of new transmission schemes, the 3$^{rd}$ generation mobile system standing at the door and the 4$^{th}$ generation to be expected maybe ten years later, provides the possibility to convey more advanced data to the wireless communication terminals, such as real time video. In order to provide good transmission and reception performance in a multi pass environment, a diversity antenna system or MIMO (Multiple Input Multiple Output) antenna system is required. This will for instance be important for WLAN (wireless local area network) and 3G and 4G cellular mobile terminals.

For circularly-polarised radio waves, a dominant-mode patch antenna is often used as a flat antenna. An antenna of this structure comprises a ceramic substrate and a patch antenna element provided on the surface of the ceramic substrate. Further, a ground conductor provided on the side of the ceramic substrate opposite to the side where the patch antenna element is disposed. A feeding pin is connected to a feeding section provided on the reverse side of the patch antenna element, by way of a through hole formed in the ceramic substrate and through the ground conductor. In principle, in the dominant-mode patch antenna, two sides which are orthogonal to each other within a plane, must be formed to an electrical length of substantially ½ wavelength. In order to make the dominant-mode patch antenna 5 compact, a dielectric substrate having a large dielectric constant must be used as the dielectric substrate. For example, the length of the side of the antenna in a GPS vehicle-mounted receiving terminal has been reduced to about one-fifth the size of a receiving terminal which is embodied without use of a substrate of high dielectric constant. Still, this means a side length of about 20 to 25 mm which, in applications involving use of a small communications device such as a portable receiving terminal, adds to much volume and weight to the terminal. The above-mentioned PIFA is easier miniaturised, but is devised for linearly-polarised radio waves.

U.S. Pat. No. 6,369,762 to Yanagisawa et al., assigned to Yokowo Co., targets the drawbacks of prior art antennas, particularly pointing out and describing the dominant-mode patch antenna, and proposes an antenna for circularly-polarised waves having a pair of electrodes for radiating a linearly-polarised wave which are provided substantially in parallel with a ground conductor plane, with an excitation electrode interposed there between. A feeding section is electrically connected to the excitation electrode, wherein first ends of the respective radiation electrodes oppose to the excitation electrode, thereby constituting capacitive coupling. Second ends of the respective radiation electrodes are connected to the ground conductor plane such that the directions in which electric fields are to be excited become substantially orthogonal to each other. The structure of the antenna is substantially L shaped, with each of the two orthogonal arms having an electrical length of ¼ of a particular radio wavelength.

SUMMARY OF THE INVENTION

The design proposed by Yanagisawa et al. provides a miniaturised antenna for circularly-polarised waves, but there is still a need for diversity in antenna systems for radio communication terminals. Hence, it is an object of the present invention to provide a compact diversity antenna for radio communication, which overcomes the deficiencies of the related prior art.

According to a first aspect, this object is fulfilled by a diversity radio antenna, comprising a ground substrate, first and second elongated antenna elements, each extending between respective first and second opposing ends in a plane parallel to and spaced from said ground substrate, and an excitation electrode interposed between said respective first ends. The ground connector switch means are devised to selectively connect and disconnect said ground substrate to said antenna elements, for controlling radiation beam pattern and polarisation diversity of the antenna.

In one embodiment, said ground connector switch means are devised to selectively connect and disconnect said respective second ends of the antenna elements to ground.

Preferably, said antenna elements extend substantially perpendicular-to each other in said plane.

In a preferred embodiment, said ground connector switch means comprises a MEMS switch.

In one embodiment, said excitation electrode is capacitively coupled to said respective first ends of said antenna elements.

Preferably, said ground connector switch means are devised to connect said first and second antenna elements to ground, for adapting the antenna to a circularly-polarised radio wave. Furthermore, said ground connector switch means are preferably devised to connect one of said first and second antenna elements to ground, and disconnect the other of said first and second antenna elements from ground, for adapting the antenna to a linearly-polarised radio wave.

In a preferred embodiment, said ground connector switch means are devised to selectively connect said first and second antenna elements to ground for adapting the antenna to a circularly-polarised radio wave, or disconnect one of said first and second antenna elements from ground for adapting the antenna to a linearly-polarised radio wave.

In one embodiment, said ground connector switch means are devised to selectively connect said ground substrate to said antenna elements over a predetermined impedance, preferably over a predetermined inductive impedance.

In a preferred embodiment, each of said first and second antenna elements have an electrical length of one quarter of a predetermined radio frequency wavelength.

Preferably a dielectric member is interposed between said plane and said ground substrate, e.g. made from a ceramic material.

In such an embodiment, said antenna elements and said excitation electrode are preferably provided on a first surface of the dielectric member, whereas said ground substrate is formed adjacent to a second surface of said dielectric member, opposite and parallel to said first surface.

Preferably, said excitation electrode are formed by a coat of an electrically conductive material provided on said first surface, whereas a first and a second spacing between said excitation electrode and said first and second antenna element, respectively, are formed by etching of said coat. Advantageously, a radio frequency feed conductor extends from said excitation electrode along a side surface of said dielectric member, to a feed pad at said second surface.

In one embodiment, said ground substrate is formed as a material layer in a printed circuit board.

According to a second aspect, the object of the invention is fulfilled by a radio communication terminal, comprising a diversity radio antenna having any of the features recited above.

BRIEF DESCRIPTION OF THE DRAWINGS

The features and advantages of the present invention will be more apparent from the following description of the preferred embodiments with reference to the accompanying drawings, on which FIG. 1 schematically shows a perspective view of a compact diversity antenna according to a first embodiment of the invention.

DETAILED DESCRIPTION OF PREFERRED EMBODIMENTS

Figure 1:
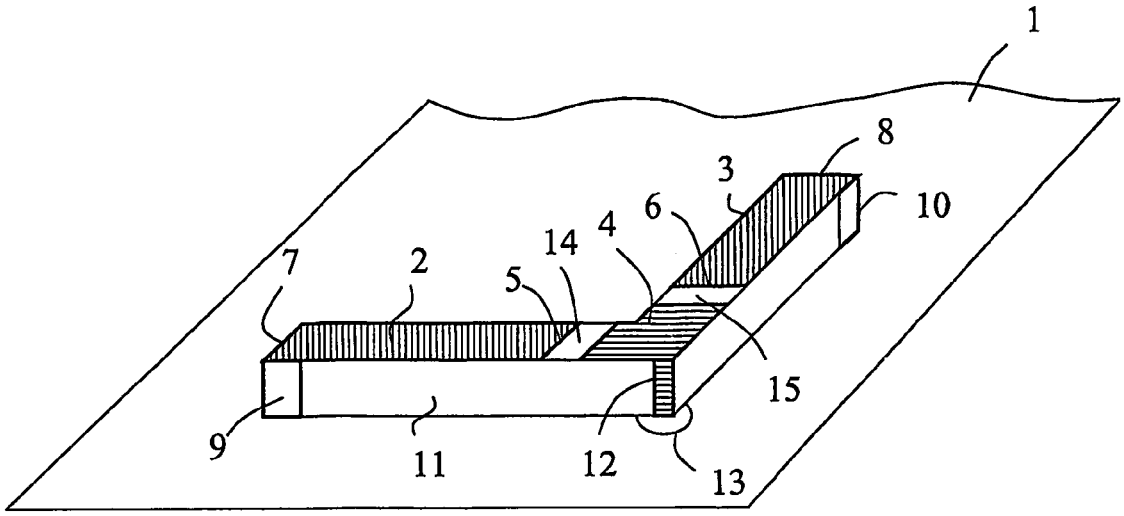

The present description refers to radio terminals as a device in which to implement a radio antenna design according to the present invention. The term radio terminal includes all mobile equipment devised for radio communication with a radio station, which radio station also may be mobile terminal or e.g. a stationary base station. Consequently, the term radio terminal includes mobile telephones, pagers, communicators, electronic organisers, smartphones, PDA:s (Personal Digital Assistants), vehicule-mounted radio communication devices, or the like, as well as portable laptop computers devised for wireless communication in e.g. a WLAN (Wireless Local Area Network). Furthermore, since the antenna as such is suitable for but not restricted to mobile use, the term radio terminal should also,be understood as to include any stationary device arranged for radio communication, such as e.g. desktop computers, printers, fax machines and so on, devised to operate with radio communication with each other or some other radio station. Hence, although the structure and characteristics of the antenna design according to the invention is mainly described herein, by way of example, in the implementation in a mobile phone, this is not to be interpreted as excluding the implementation of the inventive antenna design in other types of radio terminals, such as those listed above. Furthermore, it should be emphasised that the term comprising or comprises, when used in this description and in the appended claims to indicate included features, elements or steps, is in no way to be interpreted as excluding the presence of other features elements or steps than those expressly stated.

The aforementioned U.S. Pat. No. 6,369,762 discloses the function of an L-shaped dielectric resonator antenna, DRA, for a circularly-polarised wave, and this disclosure is hereby incorporated by reference. DRAs are known as miniaturised antennas of ceramics or another dielectric medium for microwave frequencies. A dielectric resonator whose dielectric medium, which has a relative permittivity of $\in_1 >> 1$, is surrounded by air, has a discrete spectrum of eigenfrequencies and eigenmodes due to the electromagnetic limiting conditions on the boundary surfaces of the dielectric medium. These conditions are defined by the special solution of the electromagnetic equations for the dielectric medium with the given limiting conditions on the boundary surfaces. Contrary to a resonator, which has a very high quality when radiation losses are avoided, the radiation of power is the main item in a resonator antenna. Since no conducting structures are used as a: radiating element, the skin effect cannot be detrimental. Therefore, such antennas have low-ohmic losses at high frequencies. When materials are used that have a high relative permittivity, a compact, miniaturised structure may be achieved since the dimensions may be reduced for a preselected eigenfrequency (transmission and reception frequency) by increasing $\in_r$. The dimensions of a DRA of a given frequency are substantially inversely proportional to $\sqrt{\in_r}$. An increase of $\in_r$ by a factor of $\alpha$ thus causes a reduction of all the dimensions by the factor $\sqrt{\alpha}$ and thus of the volume by a factor of $\alpha^{3/2}$, while the resonant frequency is kept the same. Furthermore, a material for a DRA is to be suitable for use at high frequencies, have small dielectric losses and temperature stability. This strongly limits the materials that can be used. Suitable materials have $\in_r$ values of typically a maximum of 120. Besides this limitation of the possibility of miniaturisation, the radiation properties of a DRA degrade with a rising $\in_r$.

Figure 2:
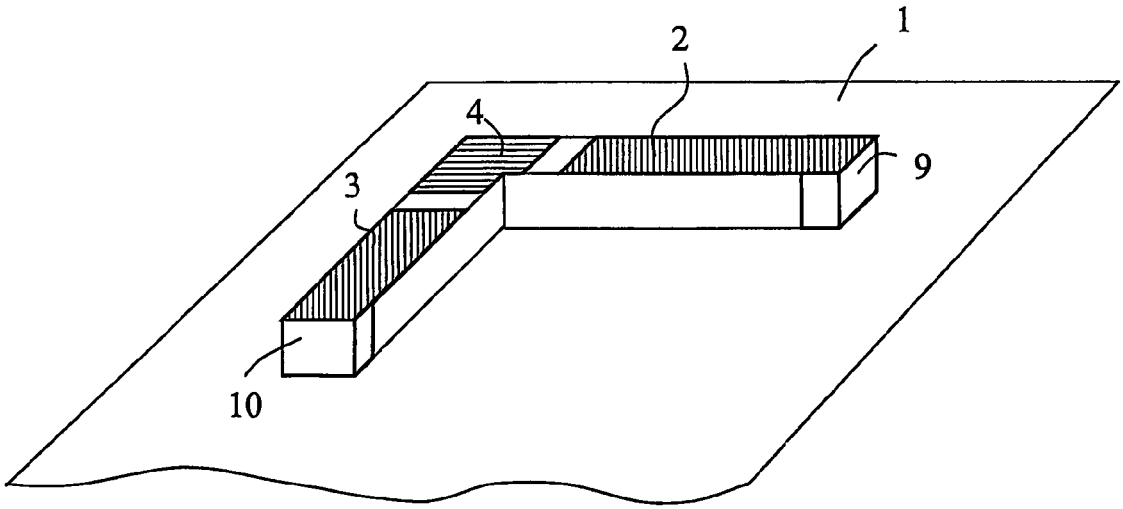
FIG. 2 schematically illustrates the antenna of FIG. 1 from another view.

FIG. 1 schematically illustrates a compact diversity radio antenna according to a first embodiment of the present invention, and FIG. 2 illustrates the same embodiment as seen from an opposite angle. The antenna is carried on a support structure, such as a printed circuit board, PCB, preferably defining a substantially plane support surface. The support structure includes an electrical ground substrate 1, which may cover a major portion of the support structure. Alternatively, the ground substrate 1 may be confined to a portion of the support structure, over which portion the antenna is placed. The ground substrate 1 is preferably realised as a material layer on an outer side or an intermediate layer of a PCB. In another embodiment, the ground substrate may be formed directly on a bottom side of the antenna. In FIG. 1, the ground substrate 1 is illustrated as a flat substrate extending beyond the antenna.

The antenna is placed on or adjacent to the ground substrate 1, and comprises 10 a substantially L-shaped dielectric member 11, having two substantially perpendicular legs extending parallel to ground substrate 1. The dielectric member 11 is made of a material having a high dielectric constant, preferably a ceramic. Non-exclusive examples of such materials include $BaO—TiO_2—SnO_2$ and $MgO—CaO—TiO_2$, which have a relative dielectric constant of about 30 or more. The dielectric member 11 has a first surface, the upper surface as illustrated in the drawing, facing away from ground substrate 1, and a second surface which is opposite and parallel to the first surface. The second surface is arranged at least adjacent to the ground substrate 1, and potentially in direct contact with the ground substrate 1, whereas the first surface defines a plane which is parallel to and spaced from ground substrate 1. Furthermore, the dielectric member preferably has straight side surfaces extending between and perpendicular to the first and second surfaces.

The structure of the antenna is predominantly arranged on the first surface of the dielectric member 11. An excitation electrode 4 is arranged at the intersection of the legs of dielectric member 11. The excitation electrode is connected to a feed pad 13 on the second surface of dielectric member 11, by means of a feed conductor 12 extending along one of the side surfaces of dielectric member 11. The feed pad 13 is only schematically illustrated in the drawing, indicating that a conductive pad connected to the feed conductor 12 is located under the marked corner of the dielectric member 11. The feed pad is connectable to a radio frequency circuit, preferably carried by a PCB acting as said support structure. The antenna further comprises two substantially elongated antenna elements 2,3, extending in the plane defined by the first surface of dielectric member 11. A first antenna element 2 extends along a first leg of dielectric member 11, from a first end 5, spaced by a gap 14 from excitation electrode 4, to a second end 7. Gap 14 provides a capacitive coupling between excitation electrode 4 and antenna element 2, for transmission and reception of radio waves. A second antenna element 3 extends along a second leg of dielectric member 11, from a first end 6, spaced by a gap 15 from excitation electrode 4, to a second end 8. Correspondingly, gap 15 provides a capacitive coupling between excitation electrode 4 and antenna element 3, for transmission and reception of radio waves. Each of the two antenna elements 2,3 preferably has an electrical length of ¼ of a centre wavelength for a predetermined radio frequency band. However, the physical length is dependent on the dielectric constant $\in_r$.

In a preferred embodiment, the antenna structure, including the excitation electrode 4 and the antenna elements 2,3, are shaped by first coating the first surfaces of the dielectric member 11 with a conductive material, by means of a suitable process. Second, the separate elements 2-4, and the gaps 14,15, are created by dry or wet etching of the coating material from the first surface. Also the feed conductor 12 may be defined in this process. In the specific embodiment of FIGS. 1 and 2, antenna elements 2,3 are rectangular, and the excitation electrode 4 extends a short portion into each of the legs of the first surface of dielectric member 11. However, it should be noted that this is only one particular embodiment, and that other shapes are possible.

Figure 3:
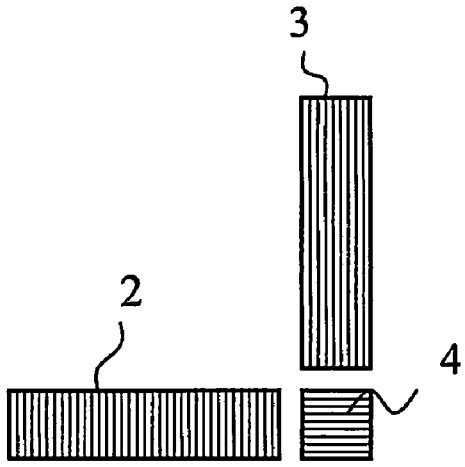
FIG. 3 schematically illustrates an exemplary second embodiment of a diversity antenna according to the invention.

FIG. 3 illustrates a second embodiment, only showing the antenna elements 2,3 and excitation electrode 4. In this example, excitation electrode 4 is rectangular, or even quadratic, and therefore does not extend into the legs of the first surface of dielectric member 11.

Figure 4:
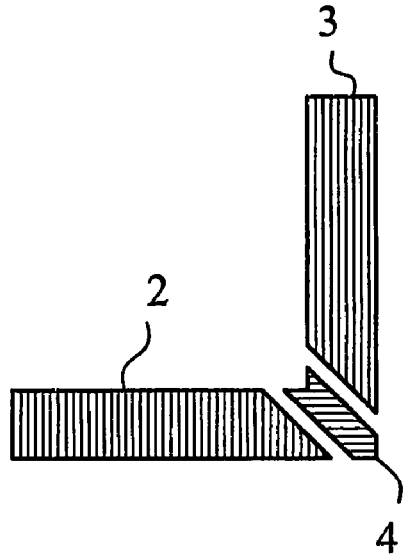
FIG. 4 schematically illustrates an exemplary third embodiment of a diversity antenna according to the invention.

FIG. 4 illustrates a third exemplary embodiment, in which excitation electrode 4 extends substantially diagonally over the intersection of the legs of the dielectric member 11. Also the first ends 5 and, respectively, of the antenna elements 2,3 are angled such that the gaps 14,15 have constant widths. Other specific embodiments of the pattern of the antenna structure are of course possible, and the antenna elements may e.g. be meandered in their extension between the respective first ends 5,6 and second ends 7,8.

The antenna elements 2,3 are selectively connected to ground substrate 1, by means of ground connector switch means 9,10. The ground connector switch means 9,10 are preferably devised to connect the antenna elements at their respective second, or outer, ends 7,8, to ground substrate 1. However, in alternative embodiments the ground connector switch means 9,10 are devised to connect the antenna elements at other portions thereof to ground substrate 1, such as at respective side edges of the elongated antenna elements 2,3.

Considered separately, each of the antenna elements 2,3 capacitively cooperates with excitation electrode 4 to form antennas adapted for transmission and reception of a linearly-polarised wave. The resonance frequency of each of the antenna elements 2 and 3 can be freely adjusted by changing the electrical length of each of the antenna elements 2 and 3. As long as the resonance frequency of either of the antenna element 2 and 3 is shifted upward relative to the centre frequency to be used, and the resonance frequency of the remaining antenna element is shifted downward relative to the same, as required, the phase of electromagnetic wave originating from one of the antenna elements can be shifted from the phase of the electromagnetic wave originating from the other antenna element. The resonance frequencies of the antenna elements 2,3 are adjusted such that a 90-degrees phase shift arises between the electromagnetic waves. More specifically, a circularly-polarised wave can be transmitted and received through use of antenna elements 2 and 3 for a linearly-polarised wave and without use of a special feeding circuit, by adjusting the length of the antenna elements 2 and 3 and the degree of coupling between the antenna elements 2 and 3, which is achieved by adjusting the width of gaps 14,15 between the antenna elements 2 and 3 and excitation electrode 4.

Figure 5:
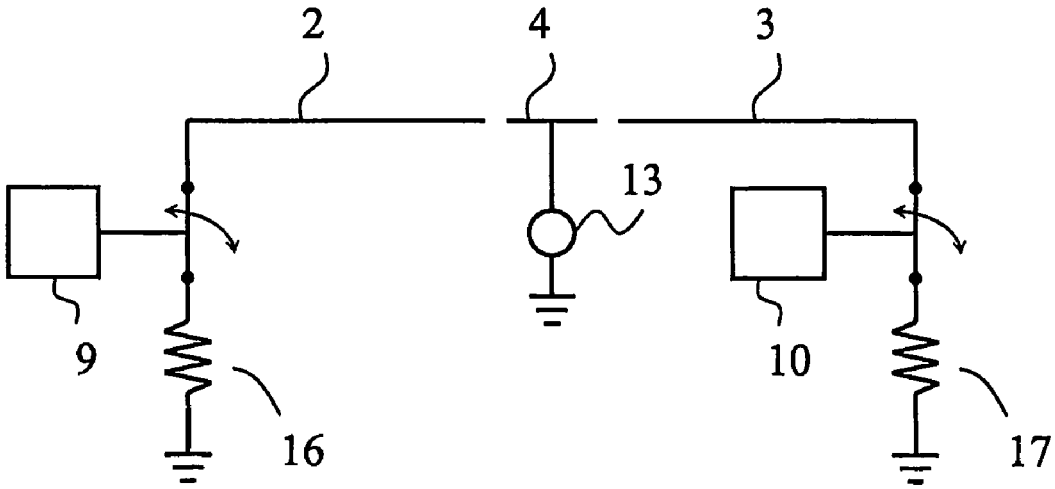
FIGS. 5-7 schematically illustrate different states of ground connector switch means in a diversity antenna according to an embodiment of the present invention.
Figure 6:
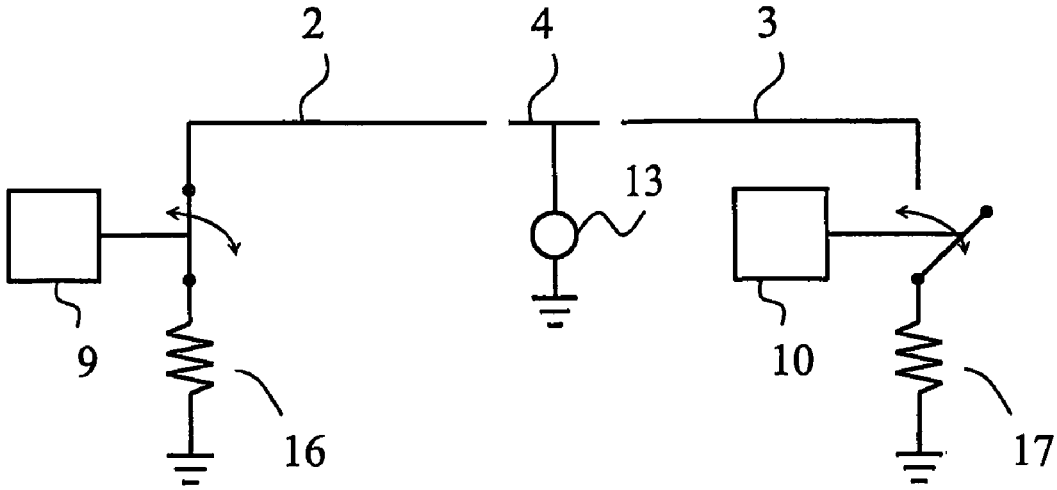
Figure 7:
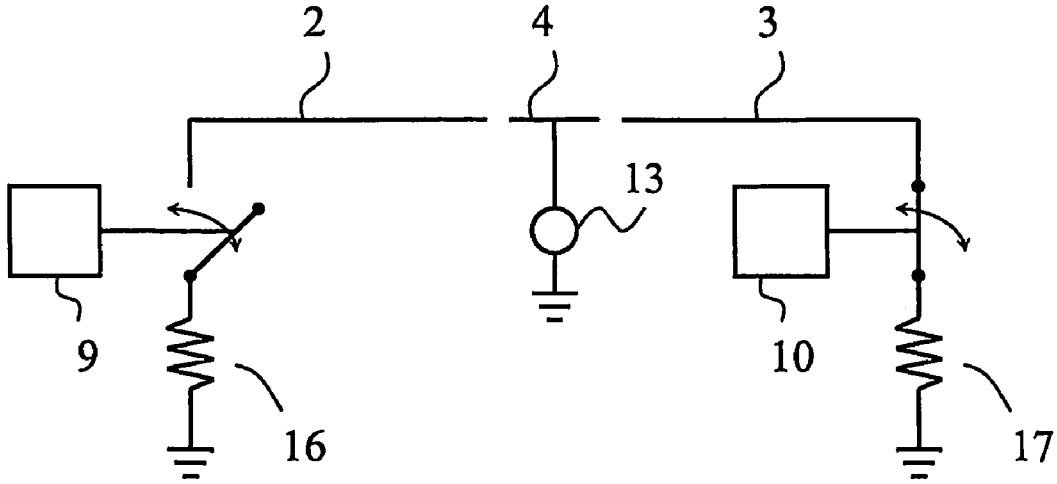

FIGS. 5 to 7 illustrate the function of the adaptable antenna according to the present invention, with the same reference numerals as in the previous drawings indicating corresponding elements. First antenna element 2 has a first ground connector switch means 9, which selectively connects the antenna element 2 to ground, and second antenna element 3 has second ground connector switch means 10, which selectively connects the antenna element 3 to ground.

FIG. 5 illustrates a state in which both ground connector switch means 9,10 are on, which means that both antenna elements 2,3 are connected to ground. As is illustrated in the exemplary drawing, each ground connection passes through an impedance 16 and 17, respectively, in this specific embodiment. Preferably, the impedance is provided by an inductive member 16,17, such as a coil. In an alternative embodiment, the inductive member 16,17 comprises a capacitive component. The switching action is preferably controlled by a Micro Electro-Mechanical Systems switch, a MEMS switch. Such a MEMS has low insertion loss and low power consumption, which provides an advantageous power saving effect to the antenna. In the state shown in FIG. 5, the antenna is adapted for circular polarisation.

FIG. 6 illustrates a state in which first ground connector switch means 9 is on, whereas second ground connector switch means 10 is off. This means that in this state only antenna element 2 is connected to ground, while antenna element 3 is electrically held in free space. Only, or predominantly, the first antenna member 2 will in this case transmit or receive for the antenna, giving it a linear polarisation. With reference to FIGS. 1 and 2, the antenna has horizontal polarisation in this state.

FIG. 7 illustrates a state in which first ground connector switch means 9 is off, whereas second ground connector switch means 10 is on, meaning that in this state only antenna element 3 is connected to ground, while antenna element 2 is electrically held in free space. Only, or predominantly, the second antenna member 3 will in this case transmit or receive for the antenna, also giving it a linear polarisation. With reference to FIGS. 1 and 2, the antenna has vertical polarisation in this state.

This way, an adaptable antenna having beam pattern and polarisation diversity is achieved, while maintaining a fixed radio frequency feeding pass. The antenna according to the invention may advantageously be used as a compact adaptive antenna for diversity or MIMO application in a radio communication terminal. In an alternative embodiment (not shown), the antenna elements 2,3 are selectively switched to ground through first and second different impedances, rather than to ground through an impedance or to free space. This will cause a resonance shift for the antenna elements 2,3, but will not affect the beam pattern and polarisation diversity to the same extent.

Figure 8:
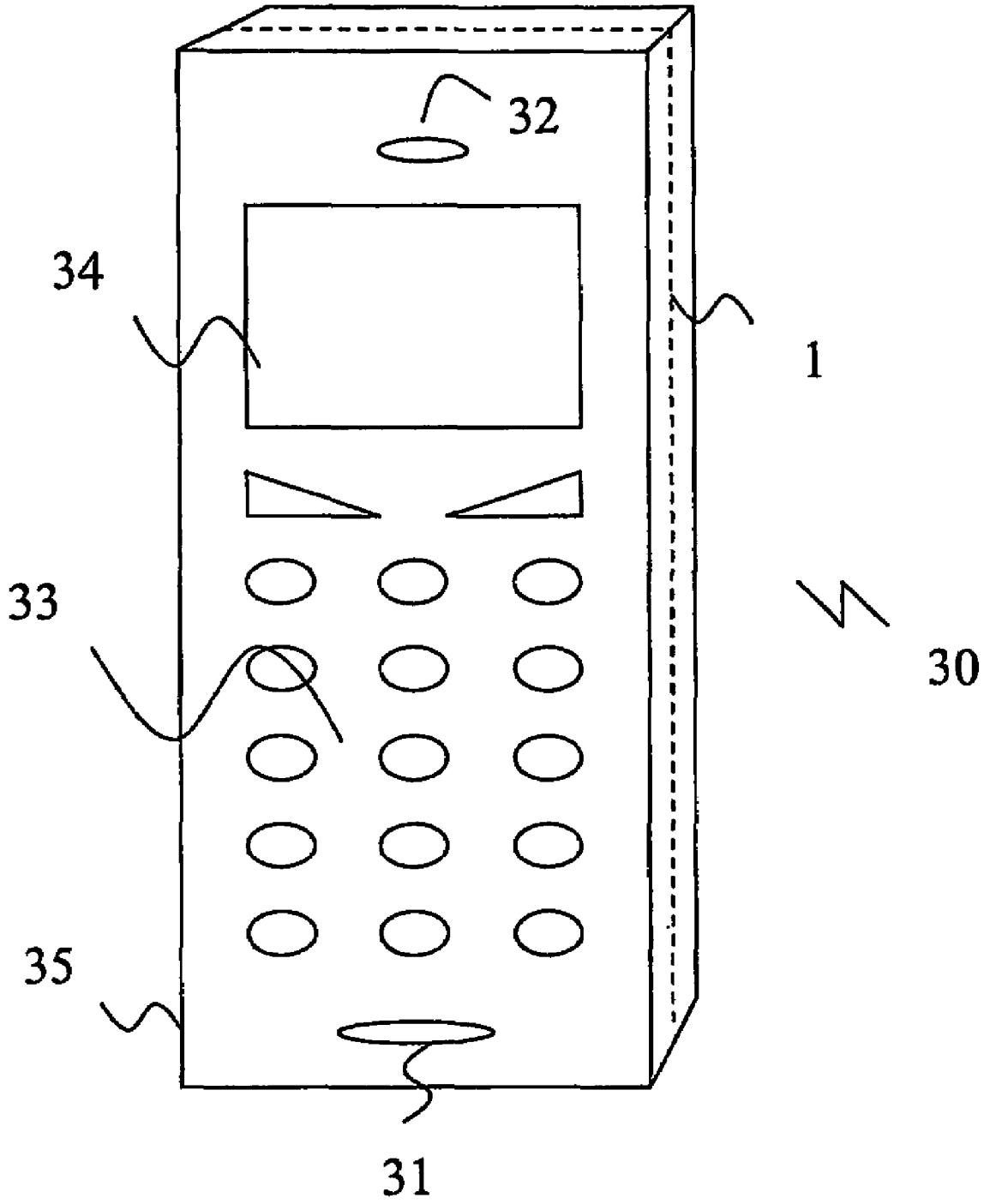
FIG. 8 schematically illustrates an exemplary communication terminal implementing an antenna design according to an embodiment of the invention.

FIG. 8 illustrates a radio communication terminal in the embodiment of a cellular mobile phone 30, devised to incorporate an antenna in accordance with the invention. The terminal 30 comprises a chassis or housing 35, carrying a user audio input in the form of a microphone 31 and a user audio output in the form of a loudspeaker 32 or a connector to an ear piece (not shown). A set of keys, buttons or the like constitutes a data input interface 33 usable e.g. for dialling, according to the established art. A data output interface comprising a display 34 is further included, devised to display communication information, address list etc in a manner well known to the skilled person. The radio communication terminal 30 includes radio transmission and reception electronics (not shown) coupled to a built-in antenna inside the housing 35, which antenna is carried on a support structure indicated in the drawing by the dashed line as a substantially flat object, preferably a PCB. According to the invention, this antenna, e.g. corresponding to FIG. 1, includes a ground substrate 1, first and second elongated antenna elements 2,3, each extending between respective first 5,6 and second opposing ends 7,8 in a plane parallel to and spaced from said ground substrate, and an excitation electrode 4 interposed between said respective first ends. Ground connector switch means 9,10 are devised to selectively connect and disconnect said ground substrate to said antenna elements, for controlling radiation beam pattern and polarisation diversity of the antenna. The other features of the antenna design according to the present invention described above are naturally equally valid for the radio terminal implemented embodiment of FIG. 8.

The foregoing has described the principles, preferred embodiments and modes of operation of the present invention. However, the invention should not be construed as being limited to the particular embodiments discussed above. For instance, the present invention is in no way restricted to the implementation of a solid dielectric member, the dielectric member could also be provided by a gas, such as air. Thus, the above-described embodiments should be regarded as illustrative rather than restrictive, and it should be appreciated that variations may be made in those embodiments by those skilled in the art without departing from the scope of the present invention as defined by the following claims.

The invention claimed is:

1. A diversity radio antenna, comprising a ground substrate, first and second elongated antenna elements, each extending between respective first and second opposing ends thereof in a plane parallel to and spaced from the ground substrate, and an excitation electrode interposed between the respective first ends, each antenna element having one grounding point connectable to the ground substrate, wherein the first antenna element has a first ground connector switch means selectively connecting or disconnecting the first antenna grounding point to the ground substrate, and the second antenna element has a second ground connector switch means selectively connecting or disconnecting the second antenna grounding point to the ground substrate, wherein the first and second ground connector switch means are configured to connect both the first and second antenna elements to ground at the same time for adapting the antenna to a circularly-polarised radio wave, and the first and second ground connector switch means are also configured to connect one of the first and second antenna elements to ground, and to disconnect the other of the first and second antenna elements from ground for adapting the antenna to a linearly-polarised radio wave.

2. The diversity radio antenna as recited in claim 1, wherein the grounding points are configured at the respective second ends of the first and second antenna elements.

3. The diversity radio antenna as recited in claim 1, wherein the first and second antenna elements extend substantially perpendicular to each other in the plane.

4. The diversity radio antenna as recited in claim 1, further comprising a MEMS switch configured to control the switching action of each of the ground connector switch means.

5. The diversity radio antenna as recited in claim 1, wherein the excitation electrode is capacitively coupled to the respective first ends of the first and second antenna elements.

6. The diversity radio antenna as recited in claim 1, wherein the ground connector switch means are configured to selectively connect the first and second antenna elements to ground for adapting the antenna to a circularly-polarised radio wave, or disconnect one of the first and second antenna elements from ground for adapting the antenna to a linearly-polarised radio wave.

7. The diversity radio antenna as recited in claim 1, wherein the ground connector switch means are configured to selectively connect the ground substrate to the antenna elements over a predetermined impedance.

8. The diversity radio antenna as recited in claim 1, wherein the ground connector switch means are configured to selectively connect the ground substrate to the antenna elements over a predetermined inductive impedance.

9. The diversity radio antenna as recited in claim 1, wherein each of the first and second antenna elements have an electrical length of one quarter of a predetermined radio frequency wavelength.

10. The diversity radio antenna as recited in claim 1, wherein a dielectric member is interposed between the plane and the ground substrate.

11. The diversity radio antenna as recited in claim 10, wherein the dielectric member is made of a ceramic material.

12. The diversity radio antenna as recited in claim 10, wherein the antenna elements and the excitation electrode are provided on a first surface of the dielectric member, whereas the ground substrate is formed adjacent to a second surface of the dielectric member, opposite and parallel to the first surface.

13. The diversity radio antenna as recited in claim 12, wherein the antenna elements and the excitation electrode are formed by a coat of an electrically conductive material provided on the first surface, whereas a first and a second spacing between the excitation electrode and the first and second antenna element, respectively, are formed by etching of the coat.

14. The diversity radio antenna as recited in claim 12, further comprising a radio frequency feed conductor extending from the excitation electrode along a side surface of the dielectric member, to a feed pad at the second surface.

15. The diversity radio antenna as recited in claim 1, wherein the ground substrate is formed as a material layer in a printed circuit board.

16. A radio communication terminal comprising a diversity radio antenna, the diversity radio antenna comprising:

a ground substrate, first and second elongated antenna elements, each extending between respective first and second opposing ends thereof in a plane parallel to and spaced from the ground substrate, and an excitation electrode interposed between the respective first ends, each antenna element having one grounding point connectable to the ground substrate, wherein the first antenna element has a First ground connector switch means selectively connecting or disconnecting the first antenna grounding point to ground, and the second antenna element has a second ground connector switch means selectively connecting or disconnecting the second antenna grounding point to ground, wherein the first and second ground connector switch means are configured to connect both the first and second antenna elements to ground at the same time for adapting the antenna to a circularly-polarised radio wave, and the first and second ground connector switch means are also configured to connect one of the first and second antenna elements to ground, and to disconnect the other of the first and second antenna elements from ground for adapting the antenna to a linearly-polarised radio wave.

17. The diversity radio antenna as recited in claim 1, further comprising an L-shaped dielectric member with substantially perpendicular legs extending parallel to the ground substrate and having a lower surface facing toward the ground substrate and an upper surface facing away from the ground substrat, wherein the first antenna element extends at the upper surface along one leg of the dielectric member and the second antenna element extends at the upper surface along another leg of the dielectric member.

18. The diversity radio antenna as recited in claim 17, wherein the excitation electrode is interposed in a gap separating the two antenna elements at an intersection of the dielectric member legs.

19. The diversity radio antenna as recited in claim 1, wherein the ground connector switch means are configured to select vertical, horizontal or circular polarization of the antenna.

* * * * *

UNITED STATES PATENT AND TRADEMARK OFFICE

CERTIFICATE OF CORRECTION

PATENT NO. : 7,405,697 B2
APPLICATION NO. : 10/549717
DATED : July 29, 2008
INVENTOR(S) : Ying It is certified that error appears in the above-identified patent and that said Letters Patent is hereby corrected as shown below:

Column 10, Claim 16, Line 17: Please correct "has a First"
To read -- has a first --

Column 10, Claim 17, Line 36: Please correct "the ground substrat,"
To read -- the ground substrate, --

Signed and Sealed this

Thirtieth Day of September, 2008

JON W. DUDAS
*Director of the United States Patent and Trademark Office*